US012396532B2

(12) United States Patent
Luo

(10) Patent No.: US 12,396,532 B2
(45) Date of Patent: Aug. 26, 2025

(54) FOLDABLE ROD OF AN UMBRELLA

(71) Applicant: Phaeton Manufacturing LLC, Nantong (CN)

(72) Inventor: Xiong Luo, Nantong (CN)

(73) Assignee: Phaeton Manufacturing LLC, Nantong (CN)

( * ) Notice: Subject to any disclaimer, the term of this patent is extended or adjusted under 35 U.S.C. 154(b) by 211 days.

(21) Appl. No.: 18/347,915

(22) Filed: Jul. 6, 2023

(65) Prior Publication Data

US 2024/0008608 A1 Jan. 11, 2024

(30) Foreign Application Priority Data

Jul. 8, 2022 (CN) ..... 202210804630.9

(51) Int. Cl.
*A45B 19/10* (2006.01)
*A45B 25/02* (2006.01)

(52) U.S. Cl.
CPC ..... *A45B 19/10* (2013.01); *A45B 25/02* (2013.01)

(58) Field of Classification Search
CPC ..... A45B 25/02; A45B 19/06; A45B 19/10; E05D 3/18; E05D 15/30
USPC ..... 135/25.31, 25.32, 31, 32, 143, 146, 151, 135/154; 16/352, 357, 360, 361, 363
See application file for complete search history.

(56) References Cited

U.S. PATENT DOCUMENTS 852,493 A * 5/1907 Brown ..... A45B 19/10 135/25.31
946,121 A * 1/1910 Garrett ..... A45B 25/02 135/32
962,539 A * 6/1910 Walton ..... A45B 19/10 135/25.31
991,632 A * 5/1911 Mroczowski ..... A45B 19/04 135/25.1
1,192,249 A * 7/1916 Ward ..... A45B 9/00 248/408
1,718,417 A * 6/1929 Greenberg ..... A45B 3/00 135/25.31
2,451,363 A * 10/1948 Sonner, Jr. ..... A01K 97/10 248/533
2,560,789 A * 7/1951 Buono ..... A45B 19/10 135/31
2,564,065 A * 8/1951 Fred ..... A01K 97/10 248/533
2,653,619 A * 9/1953 Schmidt ..... A45B 19/10 135/31
3,567,166 A * 3/1971 Grandjean ..... B41J 29/06 248/170
7,484,516 B1 * 2/2009 Yu ..... A45B 11/00 135/31

(Continued)

*Primary Examiner* — Robert Canfield
(74) *Attorney, Agent, or Firm* — Wang Law Firm, Inc.

(57) ABSTRACT

A foldable rod of an umbrella comprises a rod, a foldable extension rod connected to the tail end of the rod; wherein, the tail end of the rod has sliding grooves, the extension rod passes through the sliding grooves through a pin to be connected to the rod, and is capable of rotating and sliding along the sliding grooves, a bump is arranged in the sliding grooves, and, when the pin passes the bump and moves into limiting grooves, the extension rod is locked to the rod, which is convenient to use. The present invention is simple and reasonable in structure, easy to operate, and can effectively extend the length of rods and reduce the packaging cost.

6 Claims, 8 Drawing Sheets

(56) References Cited

U.S. PATENT DOCUMENTS

| | | | | |
|---|---|---|---|---|
| 9,032,983 | B2 * | 5/2015 | Jin | F16C 11/04 135/120.3 |
| 9,629,428 | B1 * | 4/2017 | Nei | A45B 25/18 |
| 2006/0123594 | A1 * | 6/2006 | You | A45B 19/10 16/326 |
| 2007/0283989 | A1 * | 12/2007 | Kuo | A45B 25/02 135/31 |
| 2018/0184770 | A1 * | 7/2018 | Hendrix | A45B 19/10 |

* cited by examiner

FOLDABLE ROD OF AN UMBRELLA

TECHNICAL FIELD OF THE INVENTION

The present invention relates to the field of umbrellas, and in particular to a foldable rod of an umbrella.

BACKGROUND OF THE INVENTION

As an outdoor leisure appliance, umbrella is widely used in square, beach, park, courtyard and other leisure places, providing people with comfortable cool space. In most of the existing foldable umbrellas, the canopy is supported by a number of rods to achieve the shading effect.

At present, the length of the rods of the umbrellas used outdoor is fixed and cannot be increased at will. However, to achieve a better shading effect outdoor, it is necessary to increase the shading area, and thus it is necessary to increase the length of the rods. The length of the rods of umbrellas often determines the packaging length. Too long rods will lead to a sharp increase in packaging and transportation cost.

After searching, a Chinese Patent CN210726908U (patent No.: CN201921502175.7) discloses a novel automatic folding umbrella rod. The rod comprises a first main rod and a bead tail, wherein a second main rod and a first fixed piece are hinged to the first main rod. While the rod of an umbrella of the present invention comprises a first main rod, a second main rod, a third main rod, a fourth main rod and a fifth main rod; wherein, a first connecting steel wire is hinged between the second main rod and the first fixed piece, a second connecting steel wire is hinged between the first main rod and a second fixed piece, and, a third connecting steel wire is hinged between the third main rod and a third fixed piece. The automatic folding rod is a four-fold rod, so that it occupies less space when folded and is convenient to carry, and the canopy is larger and more portable when unfolded. By pressing the sliding rod, an insertion rod is inserted into an inner cavity of the bead tail, and then into a first through hole, so that the insertion rod is inserted into the bead tail more firmly, and is effectively prevented from falling off from the bead tail when the umbrella is folded. The umbrella, foldable and carry-on, is a small umbrella and cannot be used as a large outdoor umbrella.

SUMMARY OF THE INVENTION

It is an object of the present invention to provide a foldable rod of an umbrella, which is simple and reasonable in structure, easy to operate, and can effectively extend the length of a rod of an umbrella and reduce the packaging cost.

For achieving the above object, the foldable rod of an umbrella comprises a rod having a tail end, an extension rod having a first end and an opposite second end, the extension rod being foldable relative to the rod; wherein, the first end of the extension rod is pivotally connected to the tail end of the rod, and when in an unfolded state, the extension rod is capable of being locked to the rod.

Preferably, the rod has a left sidewall and a right sidewall, the rod has two transverse sliding grooves each respectively arranged on the left and right sidewalls on the tail end of the rod, the extension rod has a corresponding pin hole on the first end of the extension rod; a pin passes through the pin hole and the sliding grooves to foldably connect the extension rod to the tail end of the rod, and the pin is slidable along the sliding grooves; each sliding groove has a lock hole at one end closer to a center of the rod and a clamping tooth as a throat at an opening of the lock hole; when the first end of the extension rod moves toward the rod in the unfolded state, the pin slides along the sliding grooves, passes the clamping teeth and moves into the lock hole, so as to lock the extension rod with the rod.

Preferably, the rod is a hollow tube.

Preferably, the rod is a hollow square tube or rectangular tube.

Preferably, the extension rod has a U-shaped section.

Preferably, the extension rod has an arc-shaped guide surface for smooth rotation at a top of the first end of the extension rod.

Preferably, a bottom edge of the extension rod tapers from the first end to the second end of the extension rod.

Preferably, the rod has a left sidewall and a right sidewall, the rod has two transverse sliding grooves each respectively arranged on the left and right sidewalls on the tail end of the rod, the extension rod has a corresponding connecting hole on the first end of the extension rod; a bolt passes through the connecting hole and the sliding grooves to foldably connect the extension rod to the tail end of the rod, and the bolt is slidable along the sliding grooves; each sliding groove has a positioning hole at one end closer to a center of the rod and a bump as a throat at an opening of the positioning hole; when the first end of the extension rod moves toward the rod in the unfolded state, the bolt slides along the sliding grooves, passes the bump and moves into the positioning hole, so as to lock the extension rod to the rod.

Compared with the prior art, the present invention has the following advantages. The rod has a pair of sliding grooves at the tail end of the rod, and the pin or the bolt inserts in the sliding grooves so as to connect the extension rod to the rod, the pin or the bolt is slidable along the sliding grooves and can roll, and each sliding groove has a clamping tooth or a bump. The pin or the bolt moves into a lock hole or a positioning hole to lock the extension rod with the rod, so that it is very convenient to use. The rod of the present invention is simple and reasonable in structure and easy to operate, and can effectively extend the length of the rod of an umbrella, increase the shading area of an umbrella, reach the functional requirements of products and reduce the packaging and transportation cost.

DETAILED DESCRIPTION OF THE INVENTION

Figure 1:
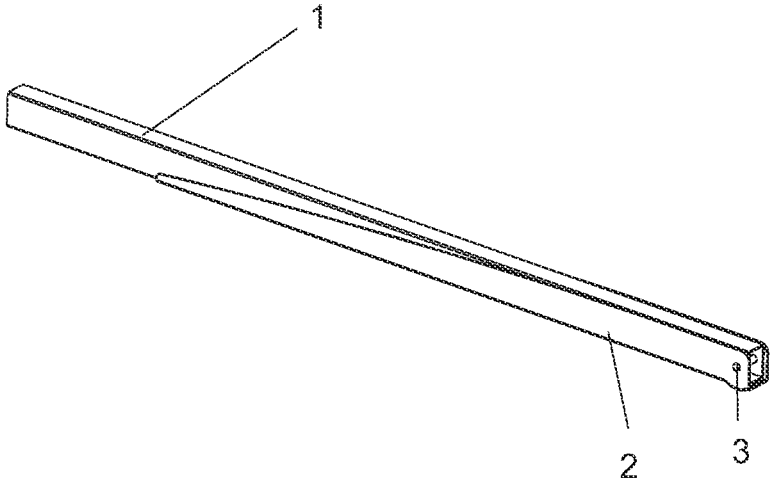
FIG. 1 is a perspective view of an foldable rod when an extension rod in a folded state according to Embodiment 1 of the present invention.

The present invention will be further described below in detail by embodiments with reference to the accompanying drawings.

Embodiment 1

FIGS. 1-8 show a first embodiment of a foldable rod of an umbrella of the present invention. The foldable rod comprises a rod 1 having a tail end, an extension rod 2 having a first end and an opposite second end, the extension rod 2 is foldable relative to the rod 1. The first end of the extension rod 2 is pivotally connected to the tail end of the rod 1, and when in an unfolded state, the extension rod 2 is capable of being locked to the rod 1.

Specifically, the rod 1 is a hollow square tube or rectangular tube. The extension rod 2 has a U-shaped section. Generally, the rod 1 has a left sidewall and a right sidewall, the rod 1 has two transverse sliding grooves 11 each respectively arranged on the left and right sidewalls on the tail end of the rod 1, the extension rod 2 has a corresponding pin hole 22 on the first end of the extension rod 2; a pin 3 passes through the pin hole 22 and the sliding grooves 11 to foldably connect the extension rod 2 to the tail end of the rod 1, and the pin 3 is slidable along the sliding grooves 11; each sliding groove 11 has a lock hole 13 at one end closer to a center of the rod 1 and a clamping tooth 12 as a throat at an opening of the lock hole 13; when the first end of the extension rod 2 moves toward the rod 1 in the unfolded state, the pin 3 slides along the sliding grooves 11, passes the clamping teeth 12 and moves into the lock hole 13, so as to lock the extension rod 2 with the rod 1, and the extension rod 2 cannot rotate and slide. The extension rod 2 has an arc-shaped guide surface 21 for smooth rotation at a top of the first end of the extension rod 2. When in an unfolded state, a bottom edge of the extension rod 2 tapers from the first end to the second end of the extension rod 2, thereby achieving the effects of reducing the weight of the frame and improving the flexibility of the rods.

The extension rod 2 is made of a rigid material or a plastic material.

The operation process is described below.

Figure 2:
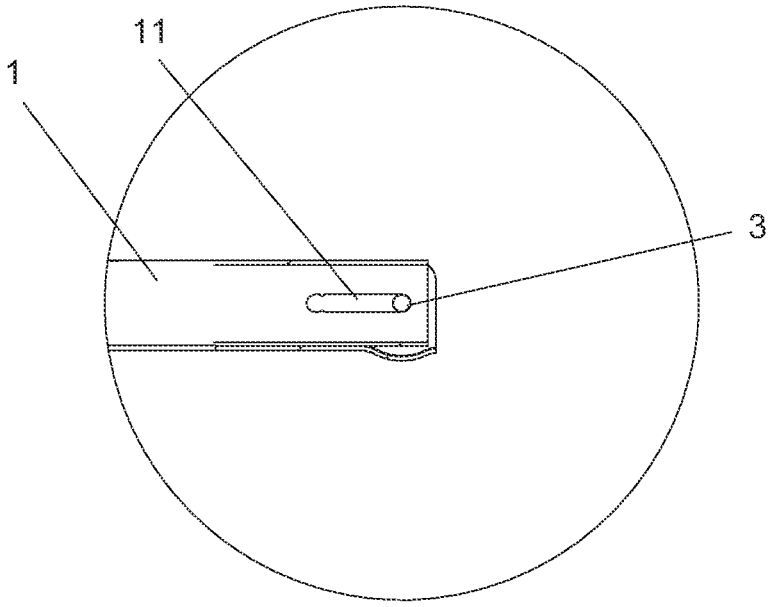
FIG. 2 is a sectional view of a joint of the rod and the extension rod in FIG. 1.
Figure 3:
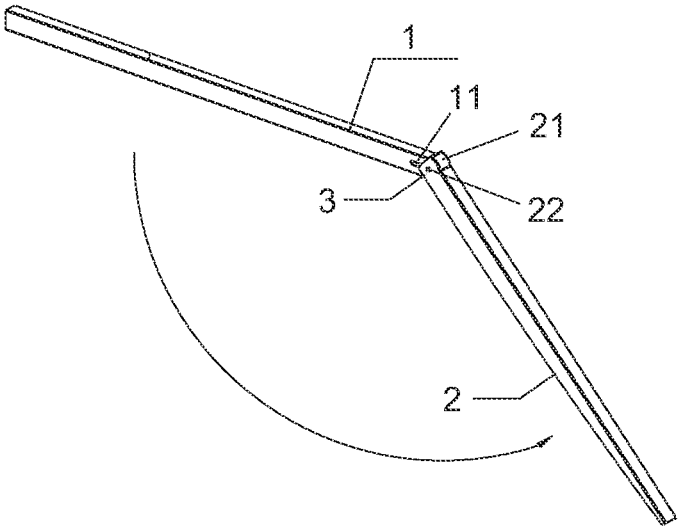
FIG. 3 is a perspective view of the foldable rod when the extension rod in an unfolded state (not completely unfolded) according to Embodiment 1 of the present invention.
Figure 4:
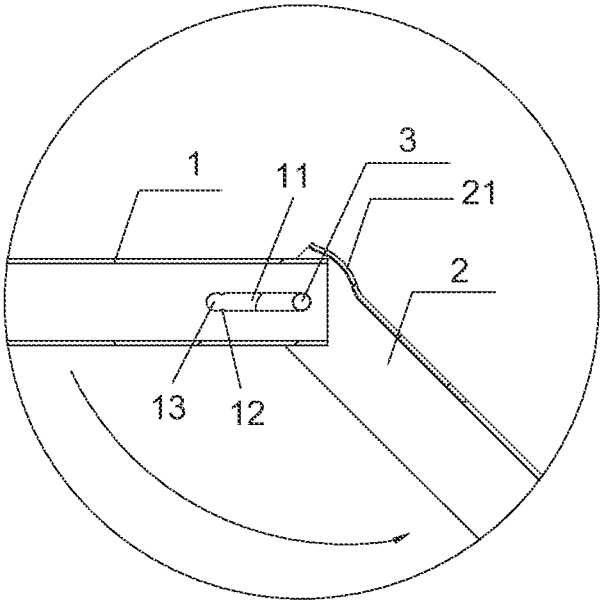
FIG. 4 is a sectional view of a joint of the rod and the extension rod in FIG. 3.
Figure 5:
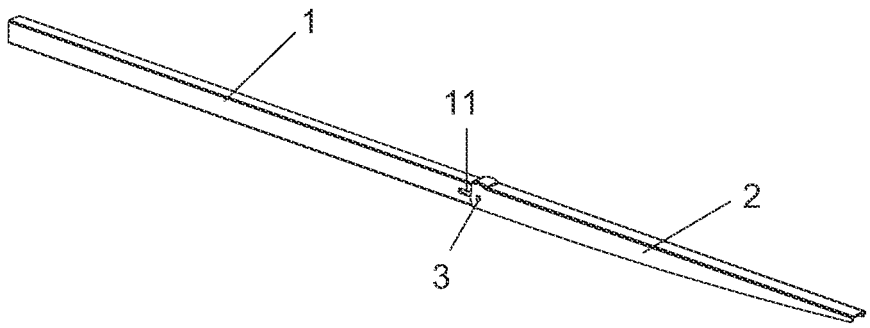
FIG. 5 is a perspective view of the foldable rod when the extension rod in an complete unfolded state according to Embodiment 1 of the present invention.
Figure 6:
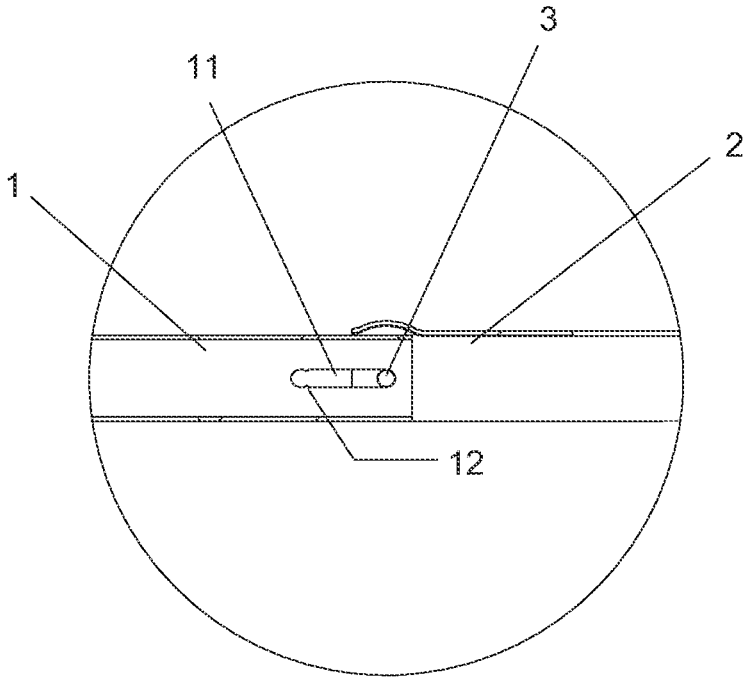
FIG. 6 is a sectional view of a joint of the rod and the extension rod in FIG. 5.
Figure 7:
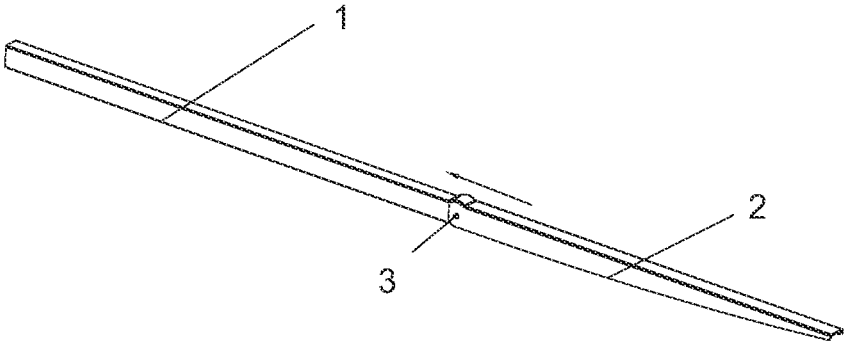
FIG. 7 is a perspective view of the foldable rod when the unfolded extension rod being pushed toward the rod to be locked with the rod according to Embodiment 1 of the present invention.
Figure 8:
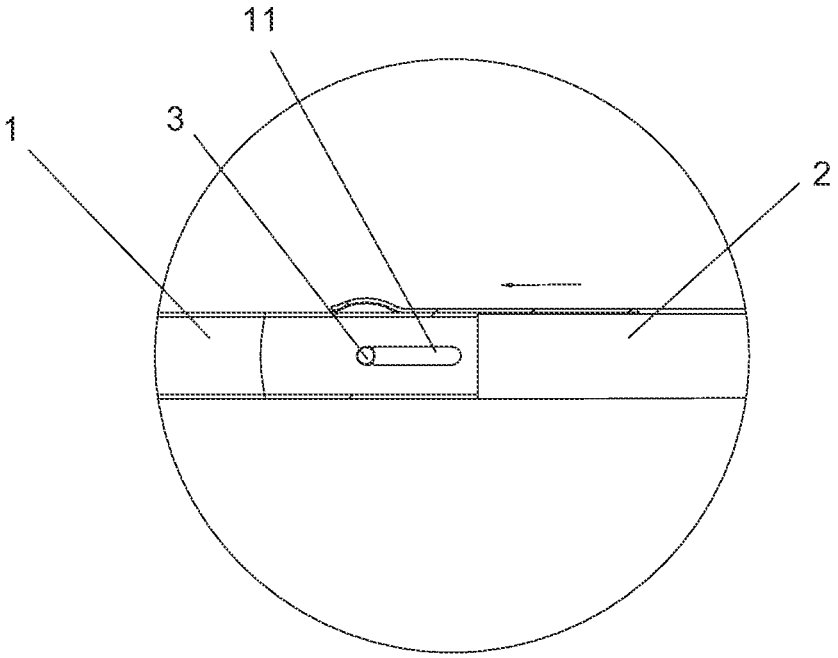
FIG. 8 is a sectional view of a part of FIG. 7.
Figure 10:
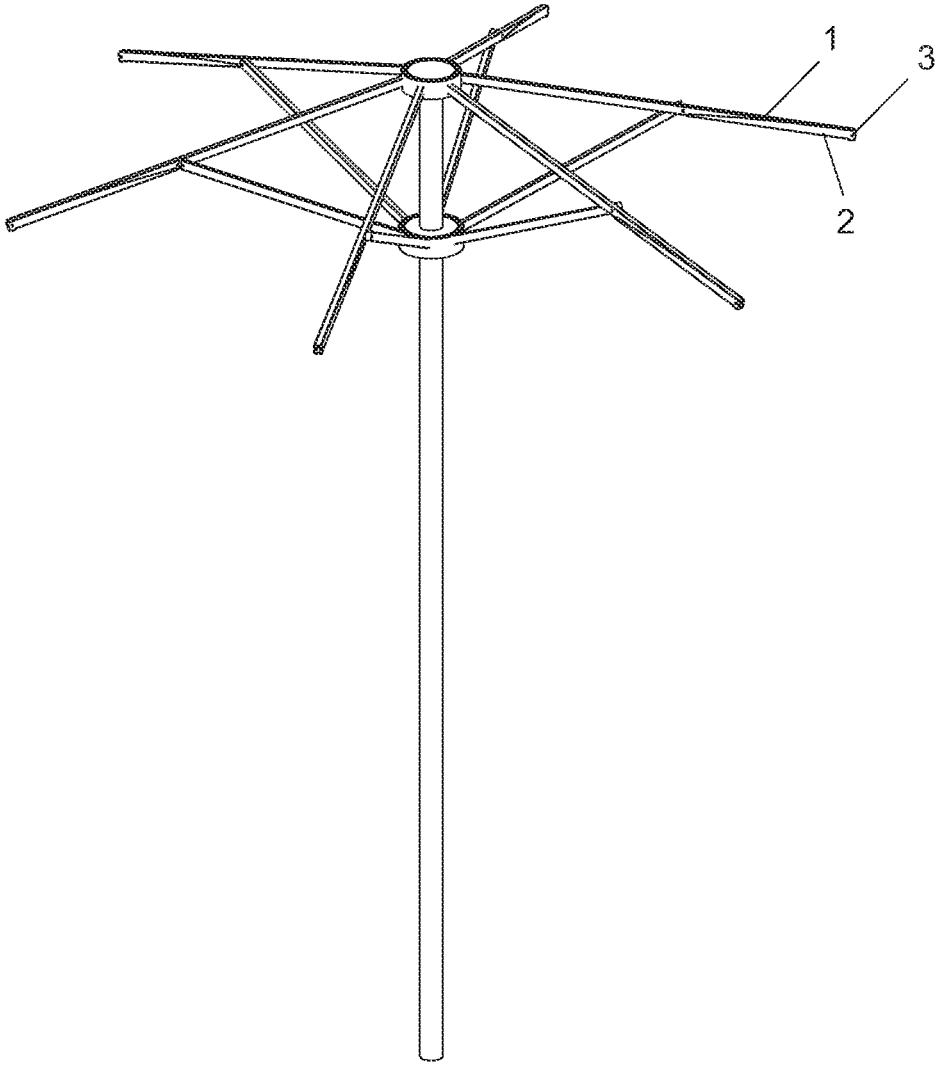
FIG. 10 is a perspective view of an umbrella having the foldable rod according to Embodiment 1 (in a folded state)
Figure 11:
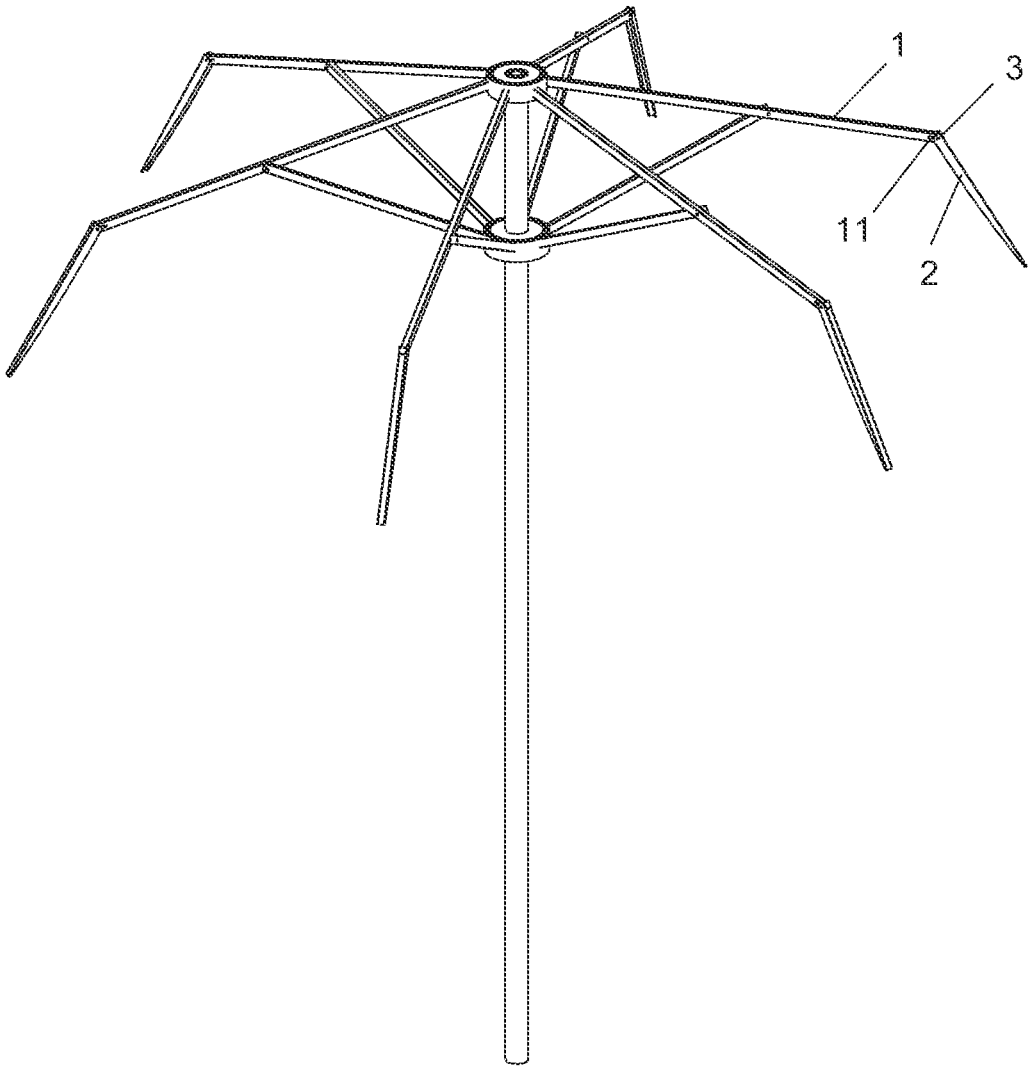
FIG. 11 is a perspective view of the umbrella having the foldable rod according to Embodiment 1 (in an unfolded state)
Figure 12:
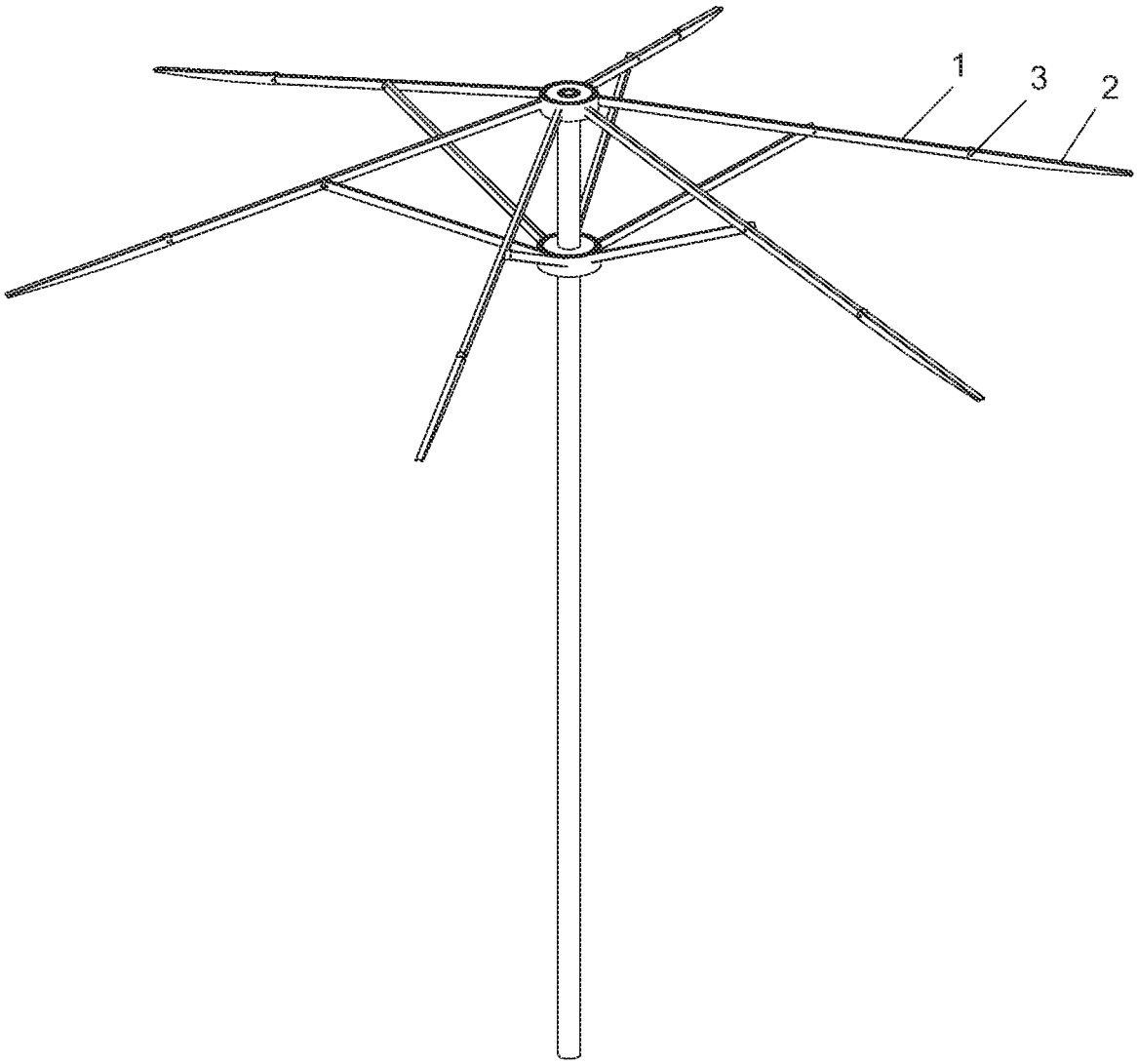
FIG. 12 is a perspective view of the umbrella having the foldable rod according to Embodiment 1 (in an unfolded and locked state).

To rotatably unfold the folded extension rod 2, as shown in FIGS. 3-4; after being rotated by 180°, the extension rod 2 is horizontally connected to the rod 1, as shown in FIGS. 5-6; and the extension rod 2 is pushed inward, as shown in FIGS. 7-8. The extension rod 2 passes through the clamping tooth 12 to be locked to the lock hole 13, so that the extension rod 1 cannot rotate or slide and is thus fixed. When the extension rod 2 needs to be folded after using, the extension rod 2 is pulled outward, the extension rod 2 passes through the clamping tooth 12 to be locked to the sliding grooves 11 and is then pulled to the outer side, so that the extension rod 2 can be folded and sleeved outside the rod 1, that is, the extension rod 2 can be rotatably folded. The folded extension rod is shown in FIGS. 1-2. The perspective view of an umbrella having the rod is shown in FIGS. 10-12.

Embodiment 2

Figure 9:
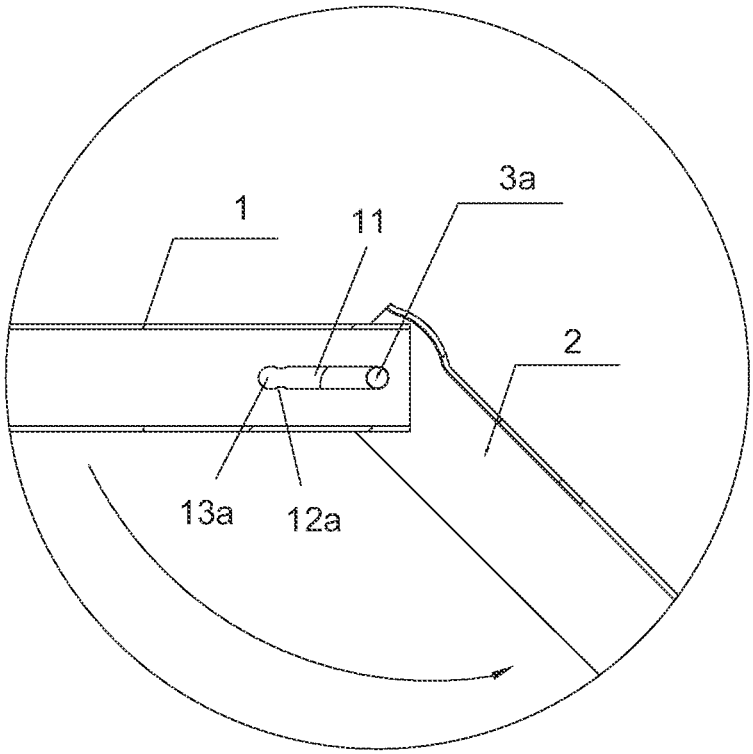
FIG. 9 is a sectional view of a part of an foldable rod according to Embodiment 2 of the present invention.

As shown in FIG. 9, the rod 1 has a left sidewall and a right sidewall, the rod 1 has two transverse sliding grooves 11 each respectively arranged on the left and right sidewalls on the tail end of the rod 1, the extension rod 2 has a corresponding connecting hole on the first end of the extension rod 2; a bolt 3*a* passes through the connecting hole and the sliding grooves 11 to foldably connect the extension rod 2 to the tail end of the rod 1, and the bolt 3*a* is slidable along the sliding grooves 11; each sliding groove 11 has a positioning hole 13*a* at one end closer to a center of the rod 1 and a bump 12*a* as a throat at an opening of the positioning hole 13*a*; when the first end of the extension rod 2 moves toward the rod 1 in the unfolded state, the bolt 3*a* slides along the sliding grooves 11, passes the bump 12*a* and moves into the positioning hole 13*a*, so as to lock the extension rod 2 to the rod 1. Other structures are similar to those in Embodiment 1.

The protection scope of the present invention is not limited to each embodiment described in this description. Any changes and replacements made on the basis of the scop e of the present invention patent and of the description shall be included in the scope of the present invention patent.

The invention claimed is:

1. A foldable rod of an umbrella, comprising:

a rod having a tail end;

an extension rod having a first end and an opposite second end, the extension rod being foldable relative to the rod;

wherein, the first end of the extension rod is pivotally connected to the tail end of the rod, the extension rod has a U-shaped section and an arc-shaped guide surface for smooth rotation at a top of the first end of the extension rod, and when in an unfolded state, the extension rod is capable of being locked to the rod.

2. The foldable rod of an umbrella of claim 1, wherein the rod has a left sidewall and a right sidewall, the rod has two transverse sliding grooves each respectively arranged on the left and right sidewalls on the tail end of the rod, the extension rod has a corresponding pin hole on the first end of the extension rod;

a pin passes through the pin hole and the sliding grooves to foldably connect the extension rod to the tail end of the rod, and the pin is slidable along the sliding grooves;

each sliding groove has a lock hole at one end closer to a center of the rod and a clamping tooth as a throat at an opening of the lock hole;

when the first end of the extension rod moves toward the rod in the unfolded state, the pin slides along the sliding grooves, passes the clamping teeth and moves into the lock hole, so as to lock the extension rod with the rod.

3. The foldable rod of an umbrella of claim 1, wherein the rod is a hollow tube.

4. The foldable rod of an umbrella of claim 3, wherein the rod is a hollow square tube or rectangular tube.

5. The foldable rod of an umbrella of claim 1, wherein a bottom edge of the extension rod tapers from the first end to the second end of the extension rod.

6. The foldable rod of an umbrella of claim 1, wherein the rod has a left sidewall and a right sidewall, the rod has two transverse sliding grooves each respectively arranged on the left and right sidewalls on the tail end of the rod, the extension rod has a corresponding connecting hole on the first end of the extension rod;

a bolt passes through the connecting hole and the sliding grooves to foldably connect the extension rod to the tail end of the rod, and the bolt is slidable along the sliding grooves;

each sliding groove has a positioning hole at one end closer to a center of the rod and a bump as a throat at an opening of the positioning hole;

when the first end of the extension rod moves toward the rod in the unfolded state, the bolt slides along the sliding grooves, passes the bump and moves into the positioning hole, so as to lock the extension rod to the rod.

* * * * *